US008701373B2

(12) United States Patent
Lindgren et al.

(10) Patent No.: US 8,701,373 B2
(45) Date of Patent: Apr. 22, 2014

(54) FLASHING MEMBER WITH A COMPENSATION MEMBER, A KIT INCLUDING SUCH A FLASHING MEMBER AND A METHOD FOR MOUNTING A FLASHING FOR A ROOF WINDOW

(75) Inventors: Claes Lindgren, Farum (DK); Niels Adelholm Larsen, Frederiksberg (DK); Johnny Christian Nygaard Rasmussen, Hedensted (DK); Jacob Lysemose, Middelfart (DK); Brent Møller, Gentofte (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 13/339,331

(22) Filed: Dec. 28, 2011

(65) Prior Publication Data

US 2012/0167483 A1 Jul. 5, 2012

(30) Foreign Application Priority Data

| | | |
|---|---|---|
| Dec. 29, 2010 | (EP) | 10197236 |
| Dec. 29, 2010 | (EP) | 10197259 |
| Jul. 4, 2011 | (DK) | 2011 70359 |
| Oct. 31, 2011 | (DK) | 2011 70590 |

(51) Int. Cl.
*E04D 1/36* (2006.01)
*E04D 3/38* (2006.01)

(52) U.S. Cl.
USPC ..... 52/747.1; 52/60; 52/61; 52/62; 52/58

(58) Field of Classification Search
USPC ..... 52/58–62
See application file for complete search history.

(56) References Cited

U.S. PATENT DOCUMENTS

| | | | | |
|---|---|---|---|---|
| 2,968,263 | A | 1/1961 | Huston et al. | |
| 5,077,943 | A | 1/1992 | McGady | |
| 2002/0095884 | A1 * | 7/2002 | Lindgren et al. | 52/200 |
| 2004/0139669 | A1 * | 7/2004 | Feucht et al. | 52/204.1 |
| 2005/0000173 | A1 * | 1/2005 | Lindgren et al. | 52/200 |
| 2005/0076583 | A1 * | 4/2005 | Quarles | 52/58 |
| 2005/0268561 | A1 | 12/2005 | Lane et al. | |
| 2008/0040993 | A1 * | 2/2008 | Valentz et al. | 52/200 |
| 2008/0184635 | A1 * | 8/2008 | Nemazi et al. | 52/200 |
| 2010/0018138 | A1 * | 1/2010 | Lundsgaard et al. | 52/200 |
| 2010/0275537 | A1 * | 11/2010 | Valentz et al. | 52/200 |

FOREIGN PATENT DOCUMENTS

| | | | |
|---|---|---|---|
| DE | 214733 | A1 | 3/1973 |
| DE | 8531994 | U1 | 2/1986 |
| DE | 7920893 | U1 | 1/1987 |

(Continued)

*Primary Examiner* — Mark Wendell
(74) *Attorney, Agent, or Firm* — Merek, Blackmon & Voorhees, LLC

(57) ABSTRACT

The invention relates to a flashing member for use with a roof window mounted on an upstand, said flashing member having at least one insulating member and a compensation member on the inner side. The compensation member, which allows use of one flashing member for different angles of the window, is preferably compressible, expandable or provided with removal indications, such as cutting lines, for allowing an easy removable of a part thereof as well as elastic. A kit including at least one such flashing member may include corner flashing members, gable flashing members, a ridge flashing members and/or supplementary insulating members. The invention further relates to a method for mounting a flashing for a roof window mounted on an upstand, where one or more connector brackets are attached to the window and where the/each flashing member is attached to the window frame via at least one connector bracket.

26 Claims, 11 Drawing Sheets

(56) References Cited

FOREIGN PATENT DOCUMENTS

Figure 1:
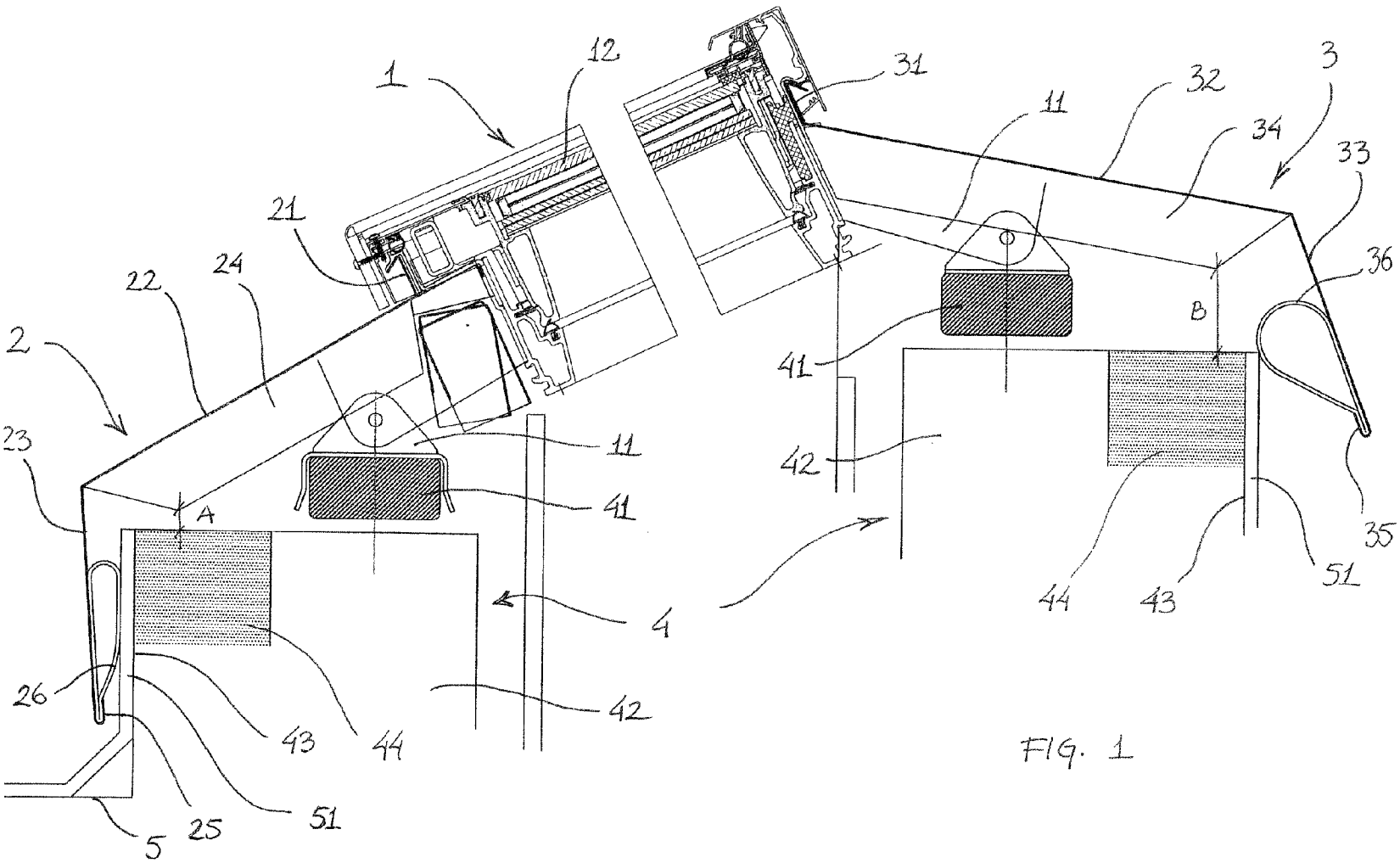

| | | | |
|---|---|---|---|
| DE | 19600509 | C1 | 4/1997 |
| DE | 20113998 | U1 | 1/2002 |
| DE | 20120837 | U1 | 5/2002 |
| EP | 0296340 | A1 | 12/1988 |
| EP | 1424455 | | 2/2004 |
| FR | 2209882 | A1 | 7/1974 |
| GB | 461238 | | 2/1987 |
| WO | WO 99/40272 | | 8/1999 |

* cited by examiner

FLASHING MEMBER WITH A COMPENSATION MEMBER, A KIT INCLUDING SUCH A FLASHING MEMBER AND A METHOD FOR MOUNTING A FLASHING FOR A ROOF WINDOW

The present application claims the priority under 35 U.S.C. 119 of European Patent Application No. 10197259.4, filed Dec. 29, 2010; European Patent Application No. 10197236.2, filed Dec. 29, 2010; Danish Patent Application No. DK 2011 70359, filed Jul. 4, 2011; and Danish Patent Application No. DK 2011 70590, filed Oct. 31, 2011, which are hereby incorporated herein by reference in their entireties.

The present invention relates to a flashing member for use with a roof window having a window frame and being mounted on an up-stand, said flashing member having an outer side intended to face the exterior in the mounted state and an inner side intended to face the window and roof in the mounted state, and said flashing member comprising a first leg being intended for being arranged against the window frame and having an upper and a lower edge; a second leg being arranged at an angle with respect to the first leg so that it projects from the window frame and having a first edge and a second edge, said first edge being connected to the lower edge of the first leg; and at least one insulating member attached to the inner side. The invention also relates to a flashing kit comprising at least two such flashing members and to a method of mounting a flashing.

WO99/40272 describes a curb window for use on a flat roof, where an insulating member having a shell of a water proof material, which serves as a flashing, is arranged adjacent to the curb. The purpose is to insulate the structure and to help direct water away from the window and hence the opening in the roof. These insulating members are made to fit the height of the curb, the upper surface of which is either horizontal or having the same inclination as the roof. They therefore can not be used in different installation situations.

Roof windows mounted on an upstand on the other hand are generally referred to as structural skylights. The two sides of the up-stand, on which the top and bottom of the window rest, have different heights, whereby defining the angle of the window, which vary a lot from building to building, since structural skylights are typically used in larger projects of unique design. They may, however, also be mounted in a so-called ridge constellation, where two windows meet top-to-top resting on a beam and with the bottoms resting on opposite sides of the upstand.

Variation in the angle of the window has implications for the flashing members, since the angles between the surface of the upstand and the external sides of the window frame depend on the angle of the window. That is, a decrease of the angle of mounting entails that the bottom flashing member is lifted away from the upstand, while the top flashing member comes closer and vice versa when the angle is increased.

Moreover, due to the elevated position on the upstand, structural skylights and particularly the flashing members used thereon are much more exposed to wind and precipitation than a traditional roof window, which is least partially embedded in the roof surface and hence protected by the roofing.

For these reasons, flashing members used with structural skylights are typically tailor made or adjusted in-situ. This has worked very well, but involves considerable costs.

It is therefore the object of the invention to provide a flashing member, which can be used for a structural skylight regardless of the angle of mounting and it is a further object of the invention to provide a method which allows the provision of a total structure suited for use on an upstand.

This object is achieved with a flashing member, which comprises a compensation member arranged on the inner side.

When the angle is changed, the compensation member compensates for the variations in the distance between the flashing member and the upstand described above, by being either compressed or expanded. This means that one and the same flashing member may be used regardless of the angle and that the angle may be adjusted in-situ if necessary.

In a preferred embodiment the compensation member at a bottom flashing member is dimensioned to fill the space occurring when the angle is only 5 degrees and is made from a compressible material allowing it to yield if the angle is increased, and vice versa for a top flashing member. A similar, though irreversible effect may be achieved by providing removal indications, such as cutting lines or weakening sections, for allowing an easy removable of an appropriate part of the compensation member. It is, however, also possible to increase the size of the compensation member, starting from the small size corresponding to a relatively large angle of the window. This may be done using an inflatable or otherwise expandable member.

To allow the compensation member to maintain a tight contact with the upstand regardless of the weather, i.e. temperature, atmospheric humidity, wind loads, snow loads etc., the compensation member is preferably elastic.

An example of a well-functioning compensation member is a tube made from a grid or perforated material, such as plastic or metal, which for a longer period of time is capable of withstanding the temperatures and humidities occurring on a roof. Such materials are known amongst other for use as leaf guards in gutters. The tube is squeezed flat at one side, giving it a drop-shape, and clamped in a folded back edge of the flashing material. The rounded side of the drop-shape has excellent elasticity and maintains a good contact with the upstand.

Using a grid or perforated material of course means that the compensation member does not function as a sealing, which may be the case with other embodiments, but this also means that any condensation formed underneath the flashing member can be drained or ventilated off. If chosen appropriately the grid or perforated material will, on the other hand, prevent leafs and small animals for entering underneath the flashing and cause damage to the insulation and/or upstand.

Other ways of attaching the compensation member to the flashing member is by gluing, welding, screws, rivets or by part of the two members engaging each other, permanently or in a releasable manner.

To make the flashing member even more resistant to the impacts experienced on a roof, the insulating member is made from a dimensionally stable material, such as polystyrene foam. Such a material gives the flashing member, which is typically made from a relatively thin sheet of aluminium, increased strength and stiffness.

A flashing kit including a flashing member as described above may also include supplementary insulating members made from a compressible insulating material, such as mineral wool. Such an insulating member, which is typically laid out on the upper side of the upstand, will be able to adapt to the angle chosen by being compressed to fit the space available. In this way the supplementary insulation may supplement the compensation member, and it is of course also possible to make the compensation member from an insulating material, such as elastic polyethylene foam.

The compensation member should be located on a section of the flashing member which is intended to be placed along the upstand in the mounted state. This could be on the second leg, in which case the compensation member will come into contact with the upper side of the up-stand. Having only first and second legs and the compensation member, however, entails that the substantially horizontal joint between the compensation member and the upstand is exposed towards the exterior unless additional covering members are added. Depending on the details of the construction, this may be acceptable, but it is preferred that the flashing member also comprises a third leg having an upper and a lower edge, the upper edge being connected to the second edge of the second leg so that the third leg projects at an angle from the second leg in a direction opposite the first leg, the third leg being intended for being arranged along an external side of the upstand. This not only provides improved water-tightness, particularly over time, but may also improve the overall appearance of the window.

The term "external" is used for surfaces facing away from the opening defined by the window frame, while the term "outer" is used to indicate that a surface faces the outside of the building.

When having a third leg the compensation member is preferably arranged at the lower edge of thereof, but it is of course also possible to provide two compensation members, one at the second and one at the third leg.

The angle between the first and second legs will depend on a number of factors such as the intended use of the flashing as upper or lower flashing member, the method of mounting the window and the construction of the upstand.

As described above the angle of the window is limited by the flashing, which possibly abuts the upstand. Flashings are normally mounted so that the first leg is substantially perpendicular to the plane of the window pane and when using an upstand having a vertical external side, which limits the position of the third leg, this defines the angle between the first and third legs: In an upper flashing member the angle of the third leg in relation to the first leg will define the lower limit of the angle interval of the window and the angle of the third leg of the lower flashing member in relation to its first leg will define the upper limit.

In a preferred embodiment, the angle interval is 5 to 25 degrees, meaning that these angles are also found between the first and third legs. The lower limit is set to make sure that the structure can be made water-tight and the upper limit to avoid having the third legs projecting too far from the upstand, which will put heavy demands on the compensation member and affect the looks of the mounted window negatively.

It will of course also be necessary to provide a waterproofing at the sides of the window and for this purpose a flashing kit may include a gable flashing member. This may include insulation and/or a compensation member as described above, but does not need to. As structural skylights are usually mounted in series of five or more close by each other, the number of gable flashing members needed is relatively limited. Accordingly, angle adaptation is not of paramount importance here and it therefore considered acceptable to use gable flashing members designed for a particular angle or a very narrow angle interval.

The gables members may include a section intended for covering the corner of the window and provide a transition to top and/or bottom flashing members, but it is of course also possible to provide separate corner members or specialised top and bottom flashing member for use at the ends of a row of windows. Furthermore, a gable member may including both corner members and top and/or bottom flashing members for the outermost window of the row.

Ridge mounting will of course demand gable and top flashing members specially designed for this mode of installation.

In this, the flashing members have been described based on their cross-sectional shapes, their different parts being termed "legs". It is, however, to be understood that each of the flashing members described have a length corresponding to the length of the frame member of the window at which it is supposed to be mounted, or to a fraction thereof, typically half the length. As is well known to the skilled person, the risk of untightness increases with the number of joints and the number of different flashing members used for flashing a window should therefore be kept at a minimum. On the other hand, other consideration such as ease of handling might justify using three or more flashing members for flashing the joint at a particular window frame member.

The further object of the invention—to provide a method which allows the provision of a total structure suited for use on an upstand—is also achieved with a method of mounting a flashing for a roof window where one or more connector brackets are attached to the window and where the/each flashing member is attached to the window frame via at least one connector bracket.

The brackets allows a reliable securing of the flashing members, even when the window frame is made from non-traditional materials, such as fibre reinforced polymers, since the brackets can be pre-attached in the state of delivery or be attached by the user at pre-prepared position on the window. This allows an easier installation with a reduces risk of errors and the screws or like fasteners used for securing the flashing members does not need to penetrate the window frame. Furthermore, the brackets allows the formation of an air gap between the window frame and at least one flashing member, which will in it self contribute to the insulation of the total structure but may also be filled with insulation material.

The connector brackets can be attached to mounting brackets at the corners of the window frame used for securing the window to the roof, but they may also be attached directly to the window frame. A combination of such brackets will often be advantageous, an example being that a bottom flashing member is attached via one or more connector brackets attached to mounting brackets and that a gable flashing member used at a side member of the window frame is attached via one or more connector brackets attached directly to the window frame. This is due to the fact that the mounting brackets will usually project essentially in continuation of the side member of the window frame and hence be located directly underneath the ends of the flashing member used at the bottom.

Flashing members may of course be secured by attachment at any place along their length, but in a preferred embodiment a projecting engagement section at one or both end edges of at least one of the flashing members is placed in engagement with at least one connector bracket.

The engagement between the flashing member and the connector bracket may in principle be achieved simply by providing the end edge of the flashing with an extension projecting over the connector bracket and driving screws through the flashing member into the connector bracket. In a preferred embodiment, however, the flashing member is provided with one or more bent edges serving as engagement sections. These bent edges will form surfaces, which, when brought into engagement with surfaces on the connector brackets, will provide a more stable engagement, particularly with regards to rotation.

At present it is preferred that such bent edges are arranged in an upwards open gutter in the upper side of the connector bracket so that they engage the longitudinal edges of the gutter. This will keep the flashing member from moving in a direction perpendicular to the gutter, and, if the dimensions of the gutter and the flashing member are further adapted so that the length of the gutter corresponds to the length of the end edge, also from moving in the longitudinal direction of the gutter. The flashing member then only needs to be secures to prevent it from coming up out of the gutter.

To ensure that two flashing members engaging the same connector bracket are aligned, the gutter is preferably of a rectangular shape, when seen from the upper side.

When the flashing member has a length corresponding to the length of the window frame member along which it is mounted, it is sufficient to provide a connector bracket at each corner of the window frame. It is, however, also possible to use more flashing members, in which case additional connector brackets may be employed, or to support the flashing member along its length by means of one or more additional connector brackets.

When mounting two or more windows side-by-side it is preferred that the flashing members used at the top and bottom of neighbouring windows, respectively, reach each other so that a separate flashing section for covering a distance between them is avoided. It is therefore preferred that in such cases a connector bracket is provided at the centre-line of the joint between the two windows, and accordingly the indication "at each corner of the window" is to be understood in its broadest sense.

The flashing member may be secured to the connector brackets solely by means of screws or like fasteners, but in a preferred embodiment a covering member is arranged to cover the joint between neighbouring flashing members. If the connector bracket is provided with a gutter, the covering member should preferably cover the upwards opening of the gutter entirely. In this way a smooth surface is provided, which is not only advantageous from an aesthetic point of view, but also prevents the collection of dirt, which may deteriorate the flashing members and/or connector bracket. Such a covering member may be attached to the connector bracket in many ways including the use of screws, and the connector bracket and/or covering member may have sections of increased strength or thickness, engagement members or the like for allowing this attachment.

The use of screws for securing flashing and covering members is a cheap and well-tested method and is therefore the method described throughout this text. It is, however, to be understood that other means of attachment, such as a click-on system, my also be used, other alternatives being readily imaginable for the skilled person.

Mounting brackets projecting substantially in continuation of the side member of the window frame may also serve as drainage member(s) leading water away from the side member of a window and from any covering or cladding members arranged thereon. This is particularly advantageous at the joint between neighbouring windows, when several windows are mounted closely side-by-side.

For this purpose the bracket is preferably gutter-shaped as described above and open-ended so that it may serve as a drain. If placing a lower edge of a flashing, cladding or covering member arranged at the side of the window in or above the gutter, water collected by these will end up in the gutter. The gutter will then take it across the bottom flashing members and discharge it onto the roof surface. The same applies to water drained via drainage channels in the window sash or frame and to connector brackets used at a top flashing member and inclined in the opposite direction, which may receive water forced upwards by wind.

Connector brackets, particularly those used for attachment of side or gable flashing members, may also be interconnected with a batten. When mounting windows on an upstand it is common to use short battens corresponding in length to the width of the upstand and the attachment of these to the connector brackets on the window may in many cases be sufficient to keep them in place.

Depending amongst other things on the material used and the method of manufacture, the connector bracket may be of a hollow configuration and in that case the hollow may be filled wholly or partially with an insulating material. Likewise, insulating material may be arranged between the window frame and at least one of the connector brackets. In this way the insulating properties of the total structure is improved.

Cladding and covering members may also be supported by or attached to connector brackets.

The connector brackets may be made from plastic, such as polyethylene (PE), polypropylene (PP) or polyvinylchloride (PVC), which has a relatively low thermal conductivity, but metals and other materials including composites may of course be employed as long as they are able to withstand the conditions on a roof.

Figure 2:
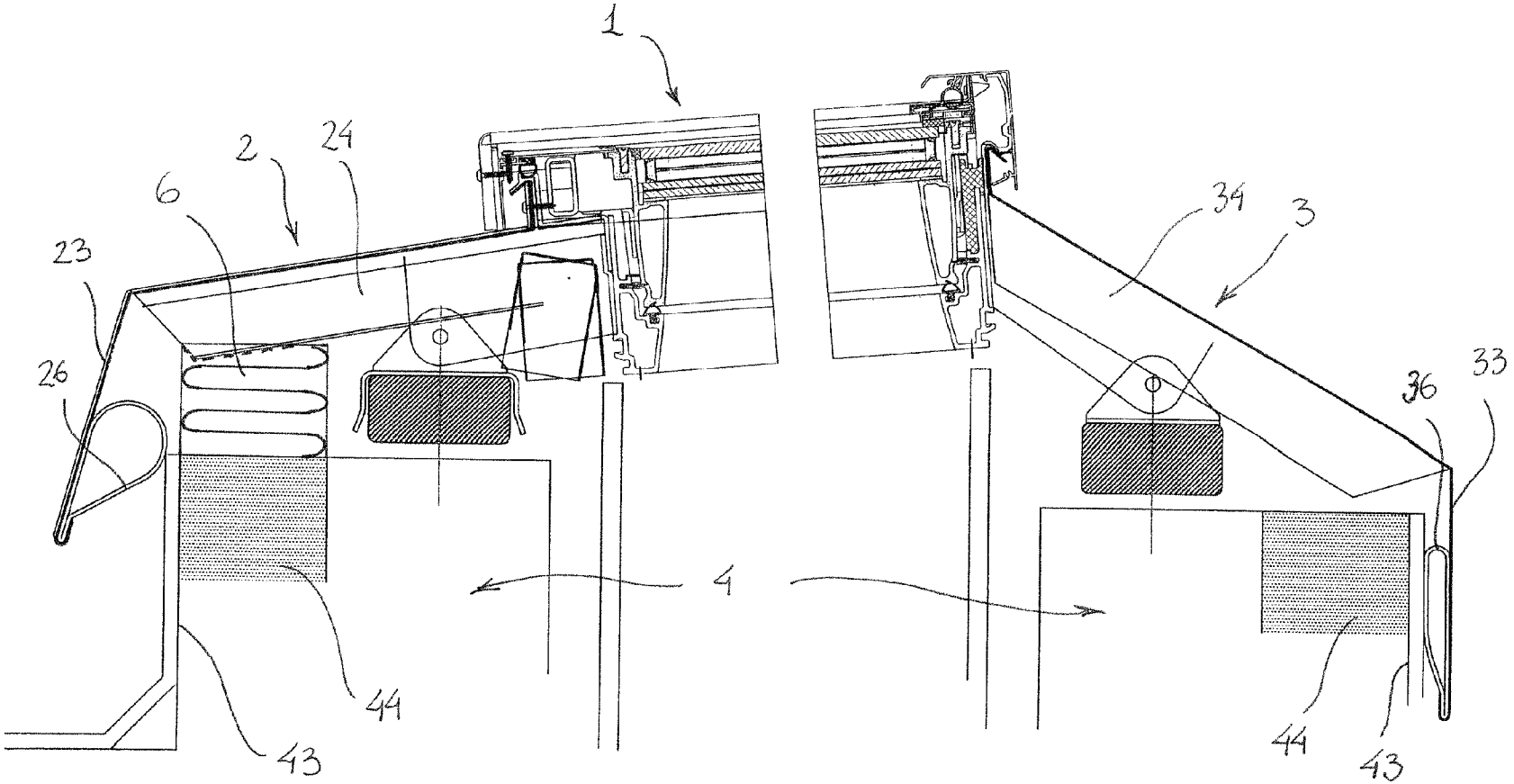
Figure 3:
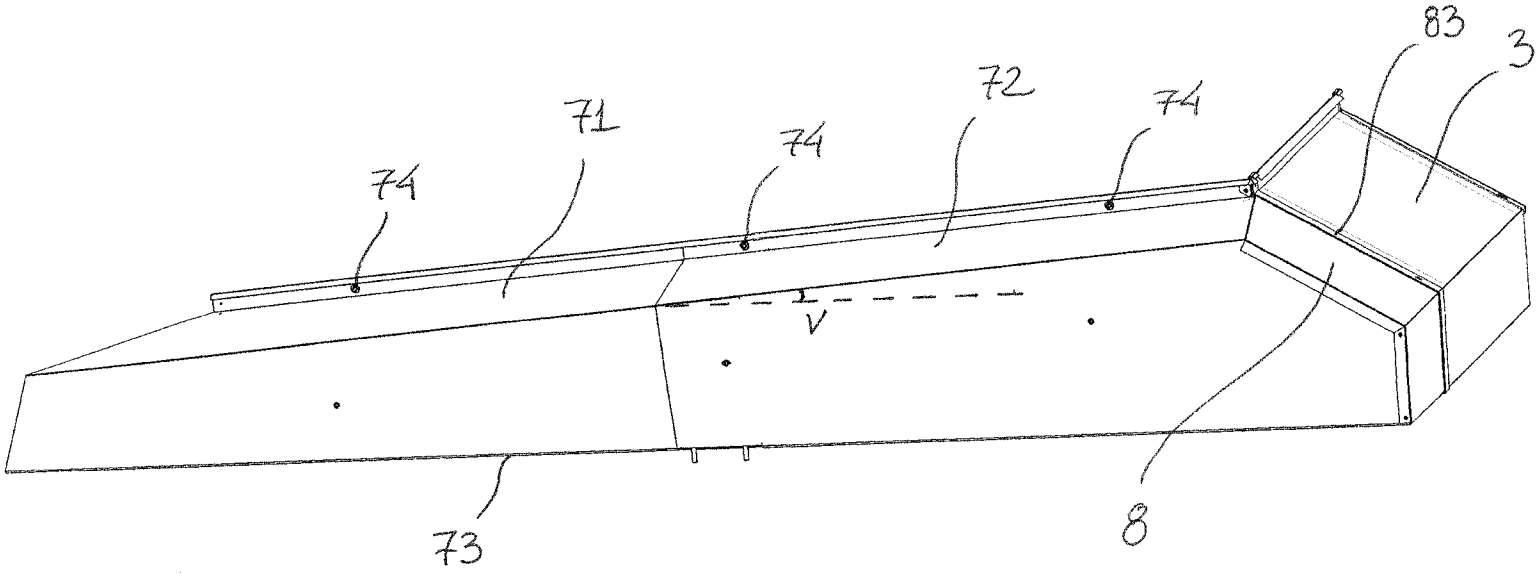
Figure 4:
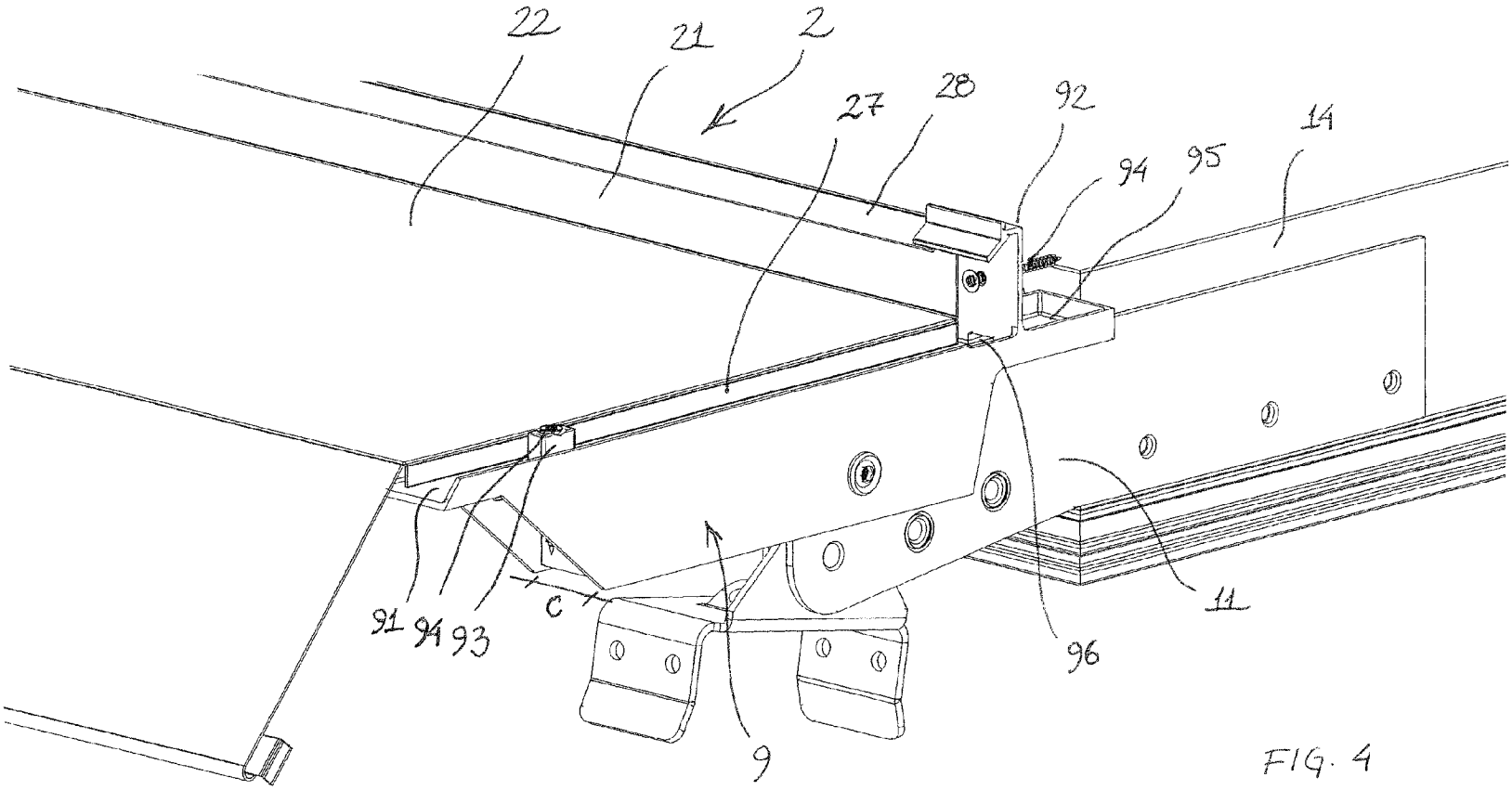
Figure 5:
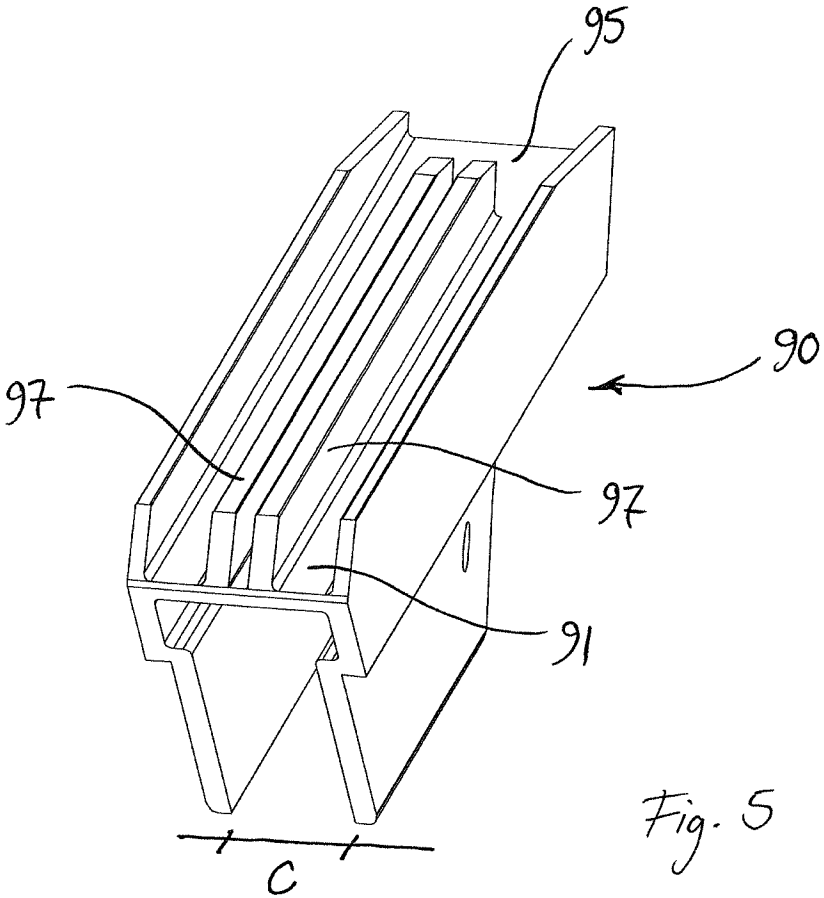
Figure 6:
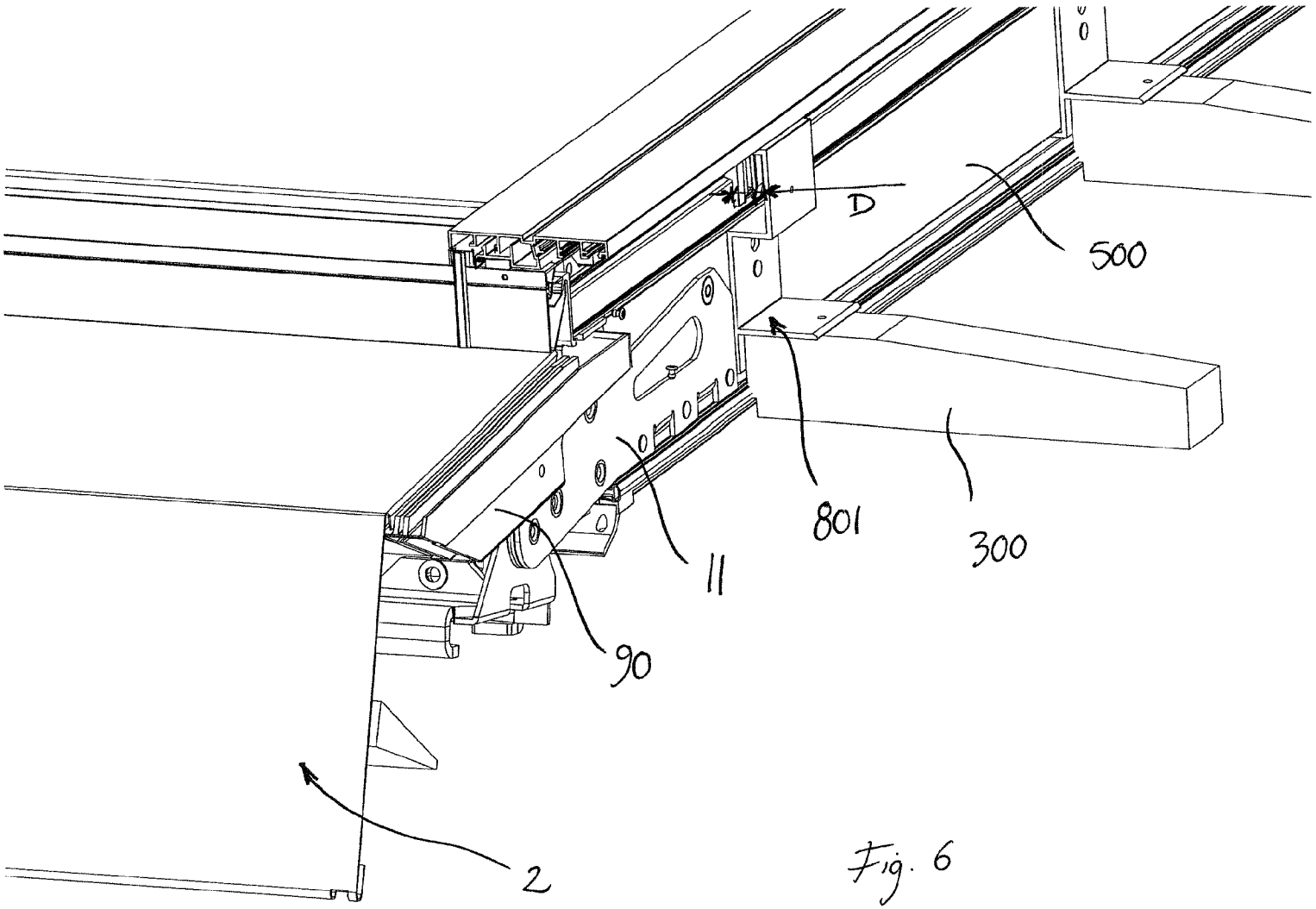
Figure 7:
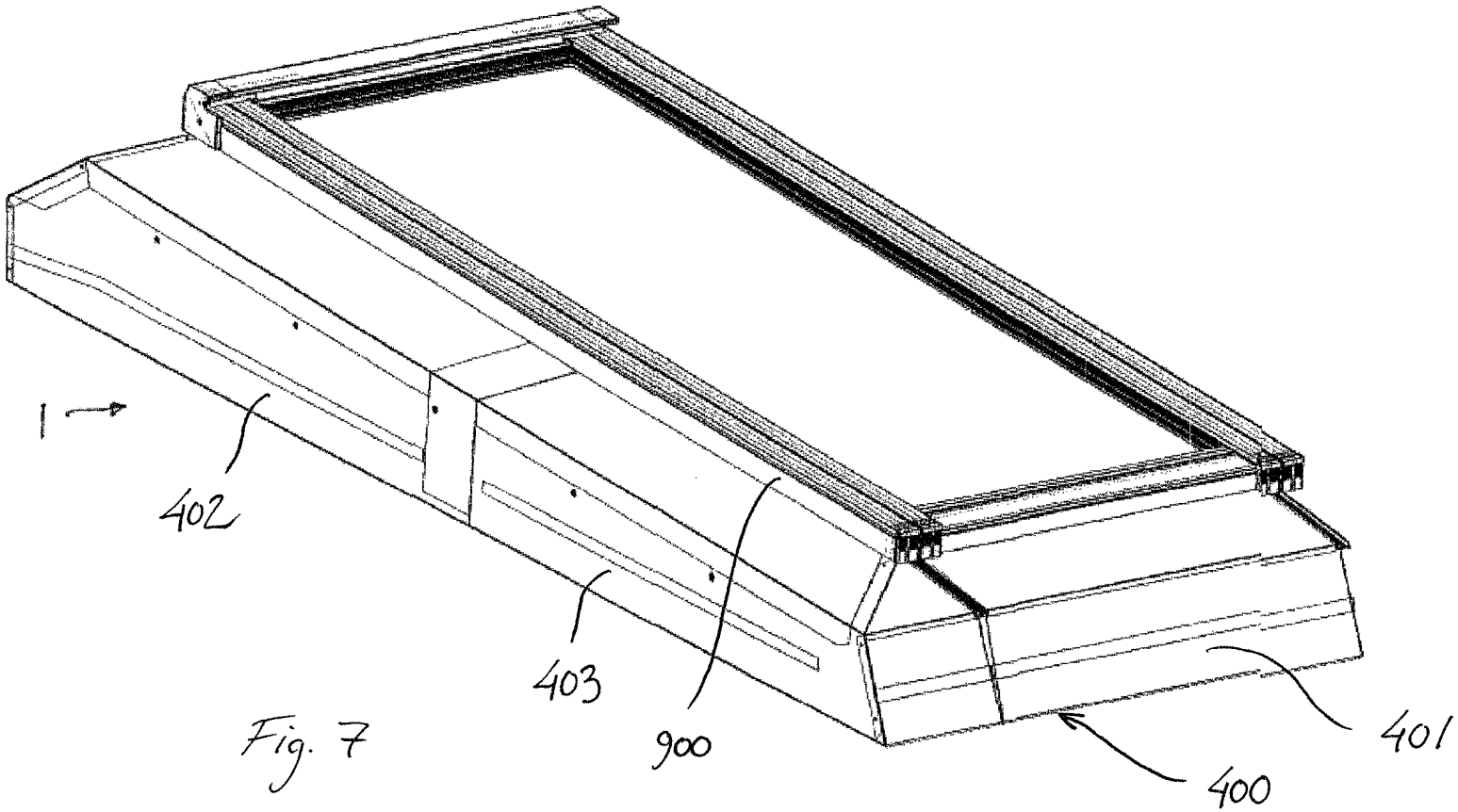
Figure 8:
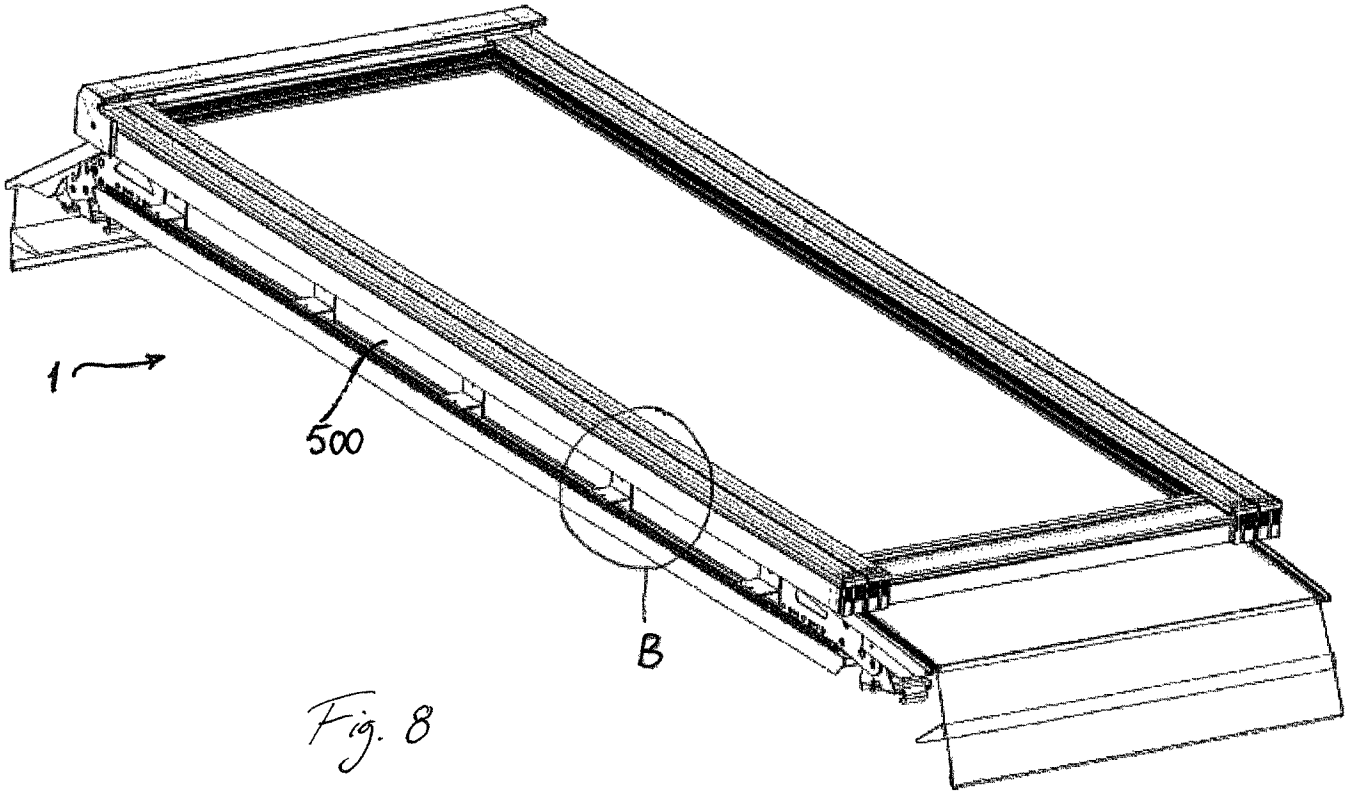
Figure 9:
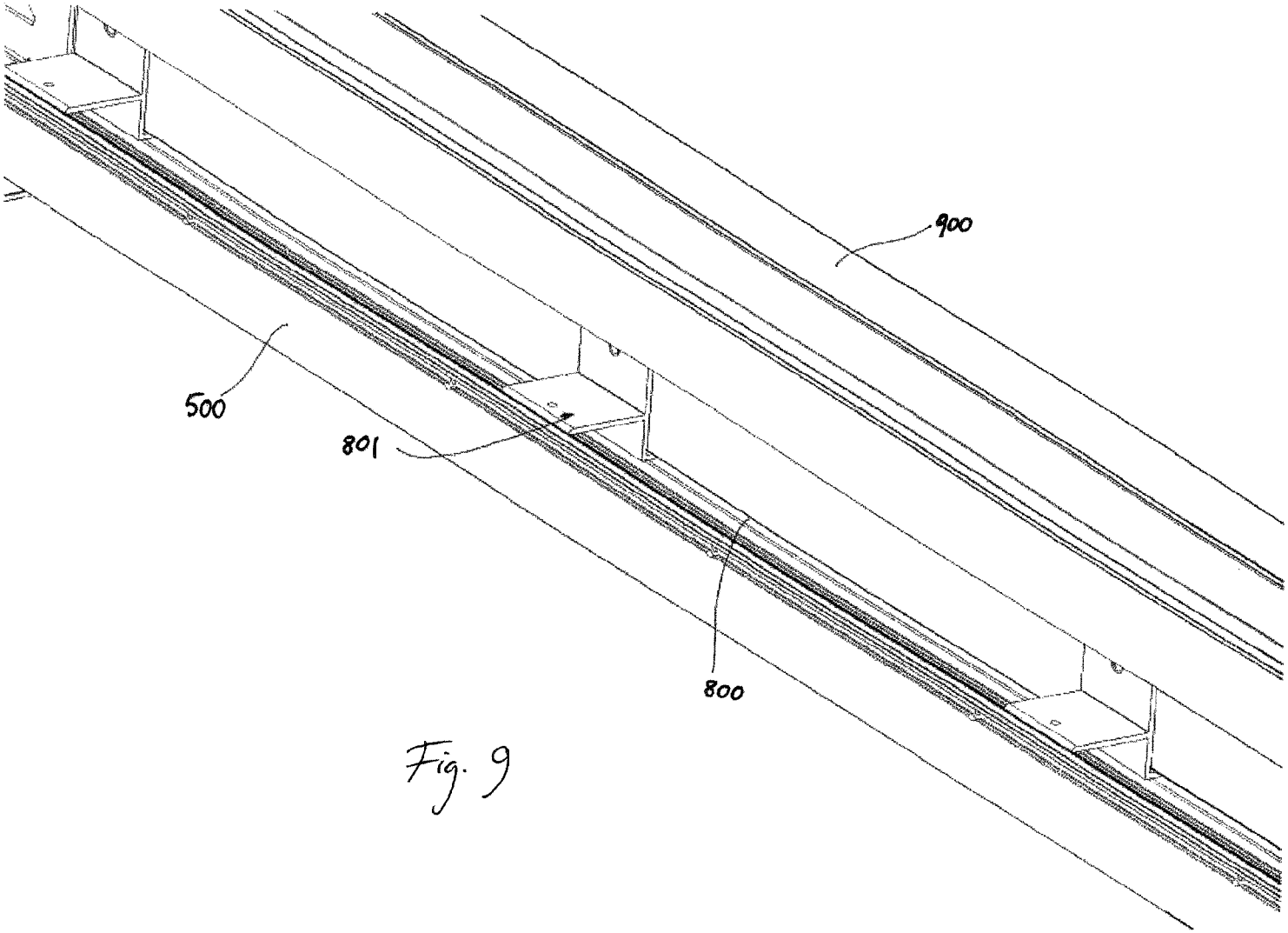
Figure 10:
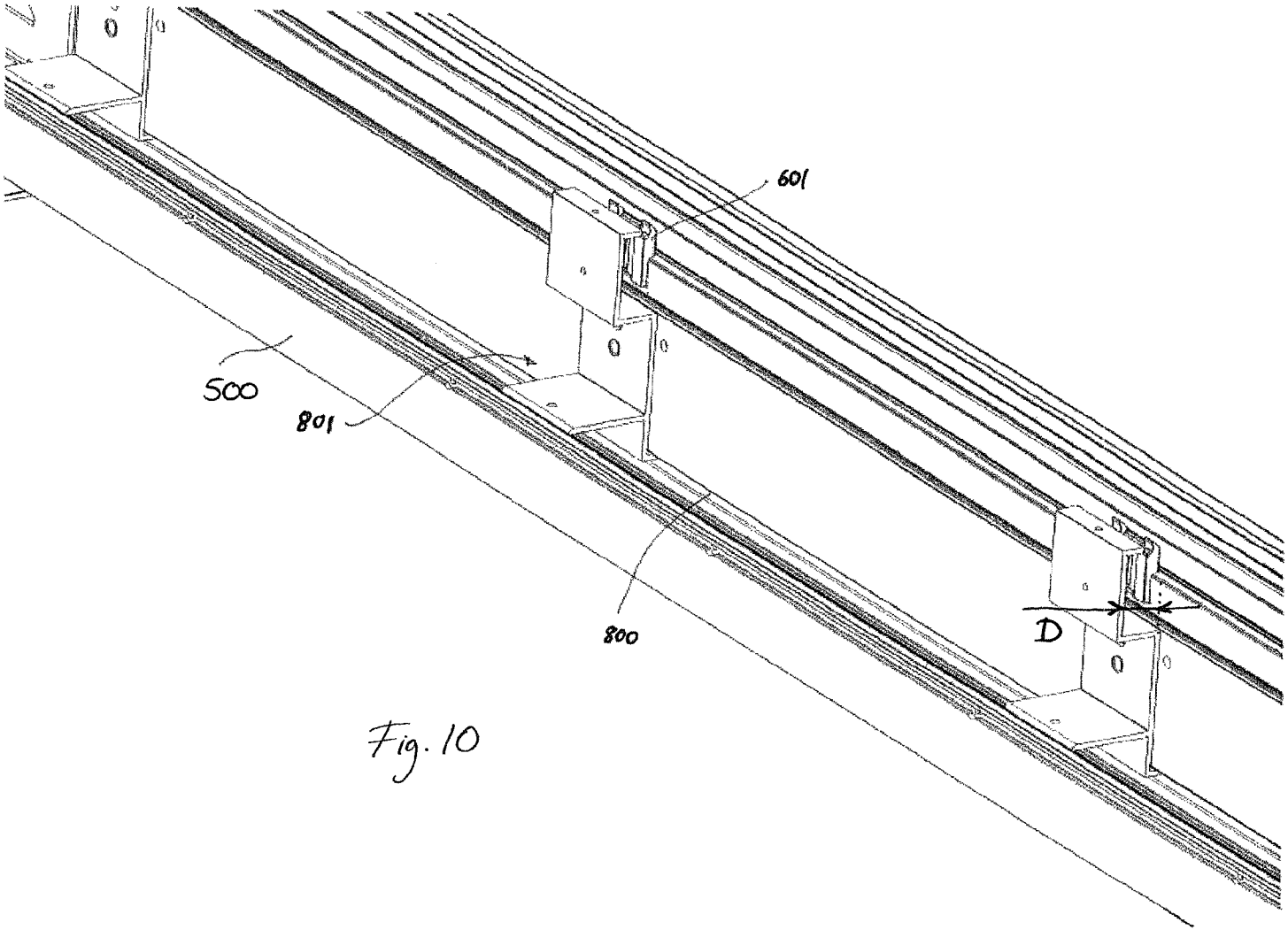
Figure 11:
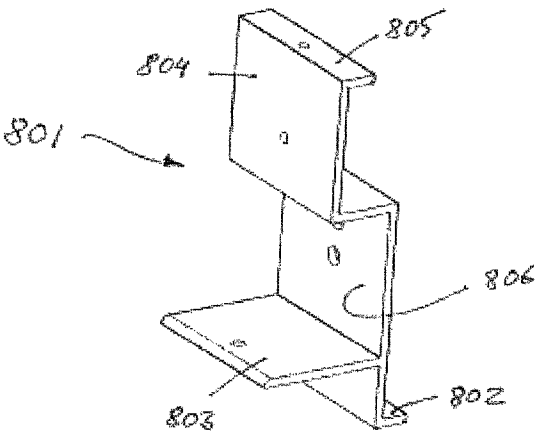

In the following, the invention will be described with reference to the drawing in which:

FIG. 1 is a cross-sectional view of a window mounted at an angle of 25 degrees, FIG. 2 is a cross-sectional view of a window mounted at an angle of 5 degrees, FIG. 3 is a perspective view of a gable and top flashing member, FIG. 4 is a perspective view of a connector bracket in the mounted state used for securing a bottom flashing member, FIG. 5 is a perspective view of an alternative embodiment of a connector bracket for the same use, FIG. 6 is a perspective view of the connector bracket in FIG. 5 in the mounted state, FIG. 7 is a perspective view of a window mounted according to the invention, FIG. 8 is a view corresponding to FIG. 7, with some parts removed, and FIG. 9-11 show partial perspective views, on a larger scale, of detail B of FIG. 8.

An example of a window 1 in the form of a structural skylight and mounted with flashing members 2,3 according to the invention is shown in FIG. 1. As may be seen, the window is resting on an upstand 4 on the roof surface 5 via mounting brackets 11 engaging beams 41 on top of the upstand. In this, the mounting brackets are shown as having a pivot joint, but other types of brackets may of course also be employed, just as the beams may be left out and the brackets attached directly to the main body 42 of the upstand.

Both the bottom flashing member 2 and the top flashing member 3 comprises a first leg 21,31, a second leg 22,32 and third leg 23,33. The first legs 21,31 are arranged against an outer surface of the window 1 so that they are substantially perpendicular to the pane 12, the second legs 22,32 project from the window over the top of the up-stand 4 and the third legs extend along the external side 43 of the up-stand, where they overlap a roof flashing 51.

An insulating member 24,34, which may also serve as a compensation member as will be described later, is provided on the inner side of the second leg 22,32 of each flashing member. It is preferred to use a dimensionally stable insulating material, such as expanded polystyrene or polyethylene foam for this purpose, since this will provide strength and stiffness to the flashing, which is usually made from a thin metal sheet. This will minimise the risk of the flashing member becoming dented during mounting and subsequent work on the roof or when being hit by hail or experiencing heavy snow loads.

At its free end the third leg 23,33 has a bend 25,35, which serves to secure a compensation member 26,36. In this embodiment the compensation member is formed from a tube-shaped material, a section of which has been compressed or pinched along the length axis so that is has assumed a drop-shape. The pinched section has then been clamped in the bend section so that the rounded section lies along the inner side of the third leg, abutting the upstand 4. To allow this, the compensation member must be made of an elastic or plastic material as will be elaborated below.

In the embodiment shown in FIG. 1, the height difference between the two sides of the upstand 4 means that the window is positioned at an angle of 25 degrees above horizontal. The third leg 23 of the bottom flashing member 2 is substantially parallel to the external side 43 of the upstand 4 and the compensation member 26 thereon is compressed almost to its maximum. The compensation member 36 on the top flashing member 3 on the other hand is just touching the up-stand 4 and the third leg 33 projects at an angle of approximately 20 degrees from the external side 43 of the upstand. If the angle of the window where to be increased, there would not be room for the third leg 23 of the bottom flashing member 2 and the compensation member 36 on the top flashing member 3 would not be able to reach the upstand 4.

The opposite situation, where the window 1 has been positioned with the smallest possible inclination, here 5 degrees, is shown in FIG. 2, which is otherwise identical to FIG. 1.

As may be seen, the bottom flashing 2 has now been lifted in relation to the upstand 4, while the top flashing 3 has come closer to it. This entails that it is now the third leg 33 of the top flashing, which is lying along the external 43 side of the upstand, while the compensation member 26 on the bottom flashing is just touching it.

If the window is positioned at any angle between these two extremes, in this case at an angle between 5 and 25 degrees, the compensation members 26,36 will adapt to the space available between the third legs 23,33 and the external side 43 of the upstand 4. For this purpose it will in principle be sufficient that the compensation member is plastic, so that it may be pressed into shape during mounting of the flashing member. This will, however, entail that the compensation member will have to be reshaped or replaced if the flashing member is for some reason pressed further down than its intended position of use and that it will not be able to compensate for any movement of the flashing member 23 and/or upstand 4 caused by for example by thermal expansion. It is therefore preferred, that the compensation member is made from an elastic material.

Preferred materials for use as the compensation members 26,36 are grids or perforated sheet materials of metal or plastic, which has the combined advantage of having excellent elasticity and allowing ventilation. Other examples of usable materials are soft plastic foams, such as polyethylene (PE), and mineral wool. In this regard it is to be understood that the compensation member does not have to be made from a tube shaped material. A folded sheet material may result in a drop-shape similar to that depicted in FIGS. 1 and 2 and a block of foam or mineral wool may function in a similar manner.

Depending on the angle of the window, there will be a smaller or larger gap between the insulating members 24,34 on the inner sides of the flashing members 2,3 and the block of insulating material 44 forming the upper external corner of the upstand 4. These gaps are indicated as A and B, respectively in FIG. 1. When the gap is small it has virtually no considerable impact on the insulating properties, but when it is big it will have. It is therefore preferred to arrange a supplementary insulating member 6, shown as a block of mineral wool in FIG. 2, on top of the upstand. The insulating member 24 on the flashing member 2 compresses the supplementary insulating member 6 as shown by the broken line, but depending on the materials used it is of course also possible that the supplementary insulating member compresses the insulating member on the flashing member. Moreover, supplementary insulating members may be provided at both sides and, as for the compensation member, the supplementary insulating member should preferably have some degree of elasticity. In this way the supplementary insulating member and insulating member on the flashing member together compensates for a distance between the flashing member and the upstand and hence may be regarded as compensation members.

It is also possible to use flashing members without the third legs 23,33, if the external side 43 of the upstand 4 is made from a weather-resistant material or if the roof flashing 51 is instead taken all the way up to the upper side of the upstand. In that case the compensation members would instead be positioned on the second legs of the flashing members, preferably approximately at the position of the supplementary insulating member in FIG. 2, the insulating member possibly functioning as the compensation member as explained above. In this respect it is noted, that use of compensation members 26,36 having relatively good insulating properties will be advantageous to maintain the insulating properties of the structure seen as a whole. Moreover, since the lack of the third leg results in an exposed horizontal joint between the flashing member 2,3 and upper side of the upstand 4, the compensation members 26,36 are preferably made with a closed surface, at least at the external side.

The changes described above in the distance and angle between the third leg 23,33 and the upstand 4, when the angle of the window is changed, of course also applies to the second leg 22,32 and hence to a compensation member (not shown) arranged thereon.

A flashing member having a third leg may also be provided with compensation members both on the third and on the second leg.

At the sides of the window, a change of the angle of the window has different consequences as will be readily apparent to the skilled person and the use of compensation members on side flashing members is therefore not necessarily advantageous. Instead it is preferred to use one or more traditional flashing members as shown in FIG. 3, which depicts two side flashing members 71,72 and a top flashing member 3, interconnected by a corner flashing member 8. The side flashing members 71,72, which are preferably provided with insulating members (not shown) on the inner sides, are made to fit a certain mounting angle of the window, corresponding to the angle V in FIG. 3. If, however, it can be accepted that the lower side 73 is not parallel with the upper surface of the roof, the side flashing may be used over a certain angle interval as long as the water-tightness is not jeopardized.

Here, the corner flashing member 8 is provided as a separate member, which may be embodied much as the top flashing member 3, but it is also possible to provide it as part of either the side flashing member 72 or the top flashing member 3. Likewise, a flashing of the lower corner may be achieved either with a separate flashing member (not shown) or by interconnecting the side flashing member 71 and the bottom flashing member 2 (not shown in FIG. 3) directly.

Such flashing members 2,3,71,72 have traditionally been attached by driving screws 74 through the flashing members and into the window frame. It is, however, preferred that at least one of the flashing members is attached by means of at least one connector bracket, examples of which are given in the following.

A connector bracket for attachment of the top and bottom flashing members is shown in FIG. 4.

Here, the bottom flashing member 2 is attached by means of a connector bracket 9 riding on the mounting bracket 11. As may be seen, the connector bracket has a substantially H-shaped cross-sectional shape, with the two lower legs extending on each side of the mounting bracket and the two upper legs forming a gutter 91. It is, however, to be understood that a connector bracket does not need to ride on the mounting bracket but may also be attached directly to the window frame.

In this embodiment, the second leg 22 of the flashing member 2 has a bent end edge 27, which engages a longitudinal edge of the gutter 91 formed in the upper surface of the connector bracket 9. This engagement keeps the flashing member 2 from moving away from the connector bracket 9 in the horizontal direction and at the centre of the gutter is a raised part 93, which prevents it from moving in the opposite direction. The gutter is open-ended at the end of the connector bracket, which is furthest from the window, to allow it to be used for drainage purposes as will be explained below, but if this is not the case, the flashing member will also be kept from moving away from the window.

The first leg 21 of the flashing member 2 is located underneath a projection 92 on the connector bracket 9 having the shape of an inverted J, which projects upwards. The height of the body of the J corresponds substantially to the height of the first leg 21, so that the upper edge of the first leg lies at the inner corner of the J, where the arm and body meets, the first leg abutting the body of the J. In this case, the first leg 21 has a bend edge 28 as is common to this kind of flashing members and the arm of the J corresponds in size and shape to this bend edge. The projection 92 may be elastic so that is can be bend slightly to ease the introduction of the flashing member 2.

The engagement between the flashing member 2 and the projection 92 prevents the flashing member from moving in the vertical direction and combined with the engagement between the bent end edge 27 and the gutter 91 the flashing member is thus fixated.

An even further fixation is achieved when a covering member (not shown) having substantially the same cross-sectional shape as the bottom flashing member 2 is subsequently attached to cover the gutter. This may be done using screws 94 penetrating the projection 92 and the raised part 93.

The attachment of the flashing member 2 to the connector bracket 9 will, under normal circumstances, be sufficient, which means that the need for penetrating the window frame for the purpose of attaching the flashing member can eliminated entirely.

A further optimisation may be achieved by using the projection 92 to support covering and cladding members (not shown), including those used at the side of the window.

A connector bracket 90 without projection may, however, also be used, an example of which is shown in FIGS. 5 and 6, where like elements have been given the same reference numbers as in FIG. 4. This connector bracket is further provided with a pair of walls 97 extending in the length direction of the gutter 91 and dividing it in three. These walls are intended as an alternative to the raised part 93 and have the advantage that the screw will get a good hold even if displaced along the length of the gutter. They may also serve as guides or abutments for the flashing members.

FIGS. 4 and 6 shows only a single flashing member 2, but it is to be understood that a second flashing member, such as the bottom flashing member of a neighbouring window, could be placed with a bent end edge engaging the opposite longitudinal edge of the gutter 91. Also the joint 83 between the top and corner flashing members in FIG. 3 could be made using a connector bracket of a similar design but with a larger angle between the projection 92 and the gutter 91.

Likewise, even though the use of the connector brackets 9, 90 is described primarily with reference to the securing of bottom flashing members, it to be understood that similar principles apply to the securing and interconnection of top flashing members.

To ensure that two flashing members engaging the same connector bracket 9, 90 are aligned, the gutter is of a rectangular shape, when seen from above. This also contributes to a narrow joint, which is advantageous both with regards to tightness and aesthetics. If, however, an angle is desired between neighbouring flashing members, this may be achieved by providing the longitudinal gutter edges at an angle to each other.

As explained above the connector brackets 9, 90 in FIGS. 4-6 is resting on the mounting bracket 11 used for interconnecting the window to the roof structure. The mounting bracket shown is substantially flush with the external side of the side member 14 of the window frame, which means that when mounting two windows side by side their mounting brackets will lie closely along each other. To allow the connector bracket 9, 90 to span both mounting brackets and thus come to lie at the centre of the joint between them, the space C between its two walls should be somewhat larger than twice the thickness of the body of the mounting bracket.

This centred position of the connector bracket 9, 90 entails that the joint between neighbouring flashing members will also be centred which will lead to an aesthetical advantage, but it is of course also possible to provide a connector bracket at each mounting bracket. In that case a separate member will be needed for covering the space or joint between the two connector members of neighbouring windows, but this may be done by means of an extra-wide version of the covering member used for covering the gutter as described above.

Alternatively, the flashing members may be provided with flanges on their inner side adapted for engagement with the gutter and have end sections projecting over the flanges to reach the neighbouring flashing member and possibly overlap it.

As is well known to the skilled person, windows are often provided with a drainage channel (not shown) at the side members of the window frame for the purpose of collecting condensation as well as any water that might penetrate the system of cladding and covering members. The centred position of the connector bracket 9, 90 allows it to be used for draining water collected by such drainage channels and possibly even for receiving water from covering members.

For this purpose the connector bracket 9, 90 has an extension 95 behind the projection 92 and the projection 92 has an opening 96 at the bottom. Water received from the drainage channel drips into the gutter 91, which extends into the extension 95 and which has a closed upper end. From here the water passes through the gutter and finally exits via the open lower end, from where it is lead onto the roof flashing 51 (not shown in FIGS. 4 and 6).

When the connector bracket 9, 90 has a hollow design as shown in FIGS. 4-6, it may be filled wholly or partially with an insulating material to minimize the risk of the connector bracket forming an undesirable thermal bridge. In the state of delivery the connector bracket may be filled substantially entirely with insulating material, which can then be removed wholly or partially to make room for mounting brackets or other means of attachment.

Turning now to FIGS. 6-11 a window generally designated 100 mounted at the end of a row of windows is provided with flashing members 400, cover members 900 and connector brackets 801 adapted for attachment thereof.

In the embodiment shown, the flashing member 401 used at the bottom is in one piece and will not be described in further detail, whereas two flashing members 402, 403 are used along the side of the window as described with reference to FIG. 3. This keeps the sizes of the flashing members relatively uniform and makes them relatively easy to handle, transport and store. Cover members between neighbouring windows are formed in a slightly different manner than the cover member 900 at the end, but will not be described in further detail. Common to all cover members is that they provide for a watertight transition between the pane and other parts of the windows.

As may be seen in FIG. 10 showing detail B of FIG. 8, connector brackets 801 are attached to the side member 500 of the frame of the window 100 on top of pre-mounted female connection brackets 601, which are intended to be used for interconnection with another window, but here no such neighbouring window is provided. The female connection brackets may advantageously contribute to the attachment of the connector brackets, though this is not the case with the embodiment shown.

Referring now to FIG. 11, each of these connector brackets 801 comprises a number of portions extending from a main portion 806. A lower flange 802 of the connector bracket 801 projects into a groove 800 in the frame side member 500 otherwise used for holding a sealing strip. This mode of attachment provides for a good resistance against rotation of the bracket, which is particularly important, when heavy winds affect the flashing and cover members. In addition, the need for screws penetrating the frame side member for attachment of the brackets is reduced, which is a particular advantage when using frame members made from fibre glass reinforced plastic.

It is preferred that all windows are made identical and that the sealing strip is then removed at the site of installation on those windows, which are to be used at the ends. It is, however, also possible to provide some windows without sealing strips or with interruptions of the sealing. Other alternatives include to use connector brackets without the flange or to provide special windows with different side members than the standard window and/or pre-mounted connector brackets for use at the ends.

A flange 803 projecting outwards perpendicularly to the side member 500 of the frame is intended for interconnection with battens 300 or insulating members used on top of the upstand as in FIG. 6. At the top the connector bracket 801 has an off-set section 804, which is used for attachment of the flashing members, the flashing members having a vertical section, which is later covered by the cover members shown in FIG. 9. Furthermore, a flange 805 serves as abutment and fixing for cover member 900, which has a leg extending along the off-set section 804 to overlap the flashing member. The section 804 being off-set means that a gap D is formed between the cover and the frame side member. This gap may be left open, filled with insulating material or used for technical installations such as wiring for solar cells or the like.

In the above, the invention has been explained with reference to a rectangular roof window, but it may also be used with windows having other shapes and with other types of roof penetrating structures such as solar panels.

The invention claimed is:

1. A flashing member for use with a roof window having a window frame including a bottom member, a top member and two side members and being mounted on an upstand and positioned at a distance from the upstand, said flashing member having an outer side intended to face the exterior in the mounted state and an inner side intended to face the roof window and a roof in which the roof window is mounted in the mounted state, said flashing member comprising:

a first leg being intended for being arranged against the window frame and having an upper edge and a lower edge, a second leg being arranged at an angle with respect to the first leg so that the second leg comes to project from the window frame and having a first edge and a second edge, said first edge being connected to the lower edge of the first leg, and at least one insulating member attached to the inner side of the flashing member, wherein a compensation member is arranged on and in direct contact with the inner side of said flashing member, the compensation member being adapted to compensate for variations in the distance between the flashing member and the upstand.

2. A flashing member according to claim 1, where the compensation member is compressible, expandable or provided with removal indications for allowing an easy removal of a part of the compensation member.

3. A flashing member according to claim 1, where the compensation member is elastic.

4. A flashing member according to claim 1, where the compensation member is a grid or perforated material having sheet or tube shape.

5. A flashing member according to claim 1, where the compensation member is attached to the flashing member by gluing, welding, clamping, screws, rivets or by part of the two members engaging each other, permanently or in a releasable manner.

6. A flashing member according to claim 1, where the insulating member is made from a dimensionally stable material.

7. A flashing member according to claim 1, further comprising a third leg having an upper edge and a lower edge, the upper edge being connected to the second edge of the second leg so that the third leg projects at an angle from the second leg in a direction opposite the first leg, the third leg being intended for being arranged along an external side of the upstand.

8. A flashing member according to claim 7, where the compensation member is arranged at the lower edge of the third leg.

9. A flashing kit comprising at least two flashing members according to claim 1, where one flashing member is designed for use as a bottom flashing member.

10. A flashing kit according to claim 9, further comprising a top flashing member and/or a gable flashing member.

11. A flashing kit according to claim 10, further comprising one or more corner members, which are integrated in a top, bottom or gable member.

12. A flashing kit according to claim 10, where the top flashing member is a ridge member designed to interconnect two windows mounted end to end at an angle to each other.

13. A flashing kit according to claim 9, further comprising one or more connector elements for connecting flashing members to the window frame.

14. A flashing kit according to claim 13, where the connector element(s) is/are adapted for riding on mounting brackets attached at corners of the window frame and to serve as drainage member(s) leading water away from the side member of the roof window.

15. A flashing kit according to claim 9, further comprising at least one supplementary insulating member made from a compressible insulating material.

16. A method for mounting a flashing, comprising the steps of:

providing a roof window mounted on an upstand, the roof window having a window frame including a bottom member, a top member and two side members;

using at least one flashing member having an outer side intended to face the exterior in the mounted state and an inner side intended to face the roof window and a roof in which it is mounted in the mounted state, where a first leg of said at least one flashing member is arranged substantially in parallel with an external side of the window frame and a second leg of said flashing member is arranged at an angle with respect to the first leg so that the second leg projects from the window frame, where one or more connector brackets are attached to the roof window and where at least one flashing member is attached to the window frame via at least one connector bracket.

17. A method according to claim 16, where connector brackets are attached to mounting brackets at corners of the window frame used for securing the roof window to the roof and/or to the window frame.

18. A method according to claim 16, where a bottom flashing member used at the bottom member of the window frame is attached via one or more connector brackets attached to mounting brackets and that a gable flashing member used at a side member of the window frame is attached via one or more connector brackets attached directly to the window frame.

19. A method according to claim 16, where at least one connector bracket is a drainage member leading water away from the side member of a window.

20. A method according to claim 16, where a projecting engagement section at one or both end edges of at least one of the flashing members is placed in engagement with at least one connector bracket.

21. A method according to claim 20, where the engagement section is a bent edge, which is arranged to project into an upwards open gutter in the connector bracket.

22. A method according to claim 16, where a flashing member is secured to a connector bracket by means of a covering member.

23. A method according to claim 16, where at least one connector bracket is interconnected with a batten.

24. A method according to claim 16, where at least one of the connector brackets is arranged to form an air gap between the window frame and at least one flashing member or covering member.

25. A method according to claim 16, where a hollow in the connector bracket is filled wholly or partially with insulation material and/or that insulating material is arranged between the window frame and at least one of the connector brackets.

26. A method for mounting a flashing for a roof window having a window frame including a bottom member, a top member and two side members and being mounted on an upstand, using at least one flashing member having an outer side intended to face the exterior in the mounted state and an inner side intended to face the roof window and a roof in which it is mounted in the mounted state, where a first leg of said at least one flashing member is arranged substantially in parallel with an external side of the window frame and a second leg of said flashing member is arranged at an angle with respect to the first leg so that it projects from the window frame, where at least one insulating member is attached to the inner side of at least one flashing member, where a compensation member is arranged on and in direct contact with the inner side of the at least one flashing member, where one or more connector brackets are attached to the roof window, and where at least one flashing member is attached to the window frame via at least one connector bracket.

* * * * *